United States Patent [19]

Slobodkin

[11] Patent Number: 4,678,457

[45] Date of Patent: Jul. 7, 1987

[54] APPARATUS FOR CONSTANT PRESSURE IN LINE-WEB CRUSH-SCORING

[75] Inventor: Yefim Slobodkin, Lyndhurst, Ohio

[73] Assignee: Avery International, Pasadena, Calif.

[21] Appl. No.: 776,850

[22] Filed: Sep. 17, 1985

[51] Int. Cl.[4] ..... B05B 1/14

[52] U.S. Cl. ..... 493/355; 83/506; 83/881; 493/60; 493/161; 493/370; 493/403; 493/471

[58] Field of Search ..... 493/59, 60, 61, 354, 493/355, 365, 370, 403, 471, 161; 83/506, 881, 469, 504

[56] References Cited

U.S. PATENT DOCUMENTS

| | | | |
|---|---|---|---|
| 2,360,653 | 10/1944 | Davidson | 83/506 |
| 3,332,326 | 7/1967 | Haas | 493/403 |
| 4,257,298 | 3/1981 | Agkut | 83/506 |
| 4,406,648 | 9/1983 | Cavagna et al. | 493/403 |

*Primary Examiner*—Frederick R. Schmidt
*Assistant Examiner*—Robert Showalter
*Attorney, Agent, or Firm*—Christie, Parker & Hale

[57] ABSTRACT

There is provided an apparatus for applying constant pressure to a knife blade for crush-scoring, wherein the knife blade is supported in a substantially frictionless manner and the constant pressure is supplied by a flexible diaphragm acting on a plunger which can move substantially without friction in a pneumatic cylinder.

6 Claims, 7 Drawing Figures

APPARATUS FOR CONSTANT PRESSURE IN LINE-WEB CRUSH-SCORING

FIELD OF THE INVENTION

The present invention is directed to an apparatus for applying constant pressure in line-web crush scoring and, more particularly, to an apparatus for crush-scoring a line-web to be used as the release liner or backing for labels, stickers, tapes, or similar articles bearing a pressure-sensitive adhesive.

BACKGROUND OF THE INVENTION

Adhesive products such as labels, stickers, tapes, and similar articles, are normally comprised of a surface sheet or facestock, a layer of adhesive, normally pressure-sensitive, secured to the back face of such surface sheet, and a removable paper backing sheet or release liner secured to the adhesive layer by a low surface-energy bond, such as by means of a silicon coating, for ultimate removal when the label, sticker, or the like, is to be affixed to an article or substrate for end-use purposes. The backing sheet can be difficult to remove because no edge is exposed to facilitate grasping the backing sheet for its removal.

One approach to overcoming the difficulties encountered in removing backing sheets, is to crush-score the backing sheet before it is silicone-released, coated, and applied to the layer of adhesive. Crush-scoring leaves a line in the backing sheet that has been weakened by a compaction of the fibres in the sheet. When a label, sticker or the like is to be affixed, it can be flexed to cause the backing sheet to split or tear along the score line, creating a pair of exposed edges for grasping and peeling off the backing sheet.

The amount of weakening that takes place during crush-scoring, however, must be carefully controlled to prevent splitting or tearing of the backing sheet while it is being processed or prepared for use, and to avoid producing labels, stickers or the like, on which splitting or tearing either occurs prematurely or does not occur upon flexing. Accordingly, a need exists for a means for uniform crush-scoring at a constant and controllable pressure.

SUMMARY OF THE INVENTION

According to the present invention, there is provided apparatus for crush-scoring paper, particularly paper used as the release liner in label construction, in which a floating force for scoring is maintained substantially constant, and is applied to the surface to be crush-scored, under essentially friction-free conditions.

The heart of the system is a support providing a pair of guide rods, preferably cylindrical, set in substantially frictionless bearings, which extend outwardly from the support and are coupled to a mounting bracket which contains, for present purposes, a circular knife adapted to crush-score paper. A plunger is positioned between the circular guides and extends between the mounting bracket and one surface of a sealed flexible diaphragm. The opposed surface is in fluid communication with a pressurized fluid, preferably gaseous, which provides the controlled, preselected force to be transmitted from the diaphragm through the plunger to the mounting bracket.

In the preferred assembly, the plunger is neither secured to the mounting bracket nor to the diaphragm. Moreover, the cooperation among the mounting bracket, the plunger, and the diaphragm, does not involve the use of frictional measures. This, coupled with the use of essentially frictionless mounted guides, insures that the mounting bracket will float, and that the force applied to the mounting bracket will be essentially unidirectional, as controlled by the amount of fluid pressure applied to the diaphragm.

In a system for crush-scoring paper, a plurality of knife assemblies are positioned in line along a support bar, each knife assembly being independently controlled in respect of the force applied to the knives, and each being readily removable as wear or damage dictates. A web of paper passes between the knives and a cylindrical anvil, which preferably has removable sleeves to enable their change, again in consequence of wear or damage.

In the process of scoring the web, paper from a roll is passed between the anvil and the plurality of knife assemblies, with pressure applied against each being tailored to achieve the depth of score desired for appropriate cracking performance of the paper. Backlighting enables inspection of fluctuations in depth of the score, and adjustment of the applied pressure accordingly. The knives have rounded, precision-ground crushing edges.

By use of the apparatus of the instant invention, higher-quality scores than ever previously achieved, may be realized for uniform performance of the products in the hands of the consumer.

BRIEF DESCRIPTION OF THE DRAWINGS

These and other features and advantages of the present invention, will be better understood by reference to the following detailed description, when considered in conjunction with the accompanying drawings, wherein.

DETAILED DESCRIPTION

Figure 1:
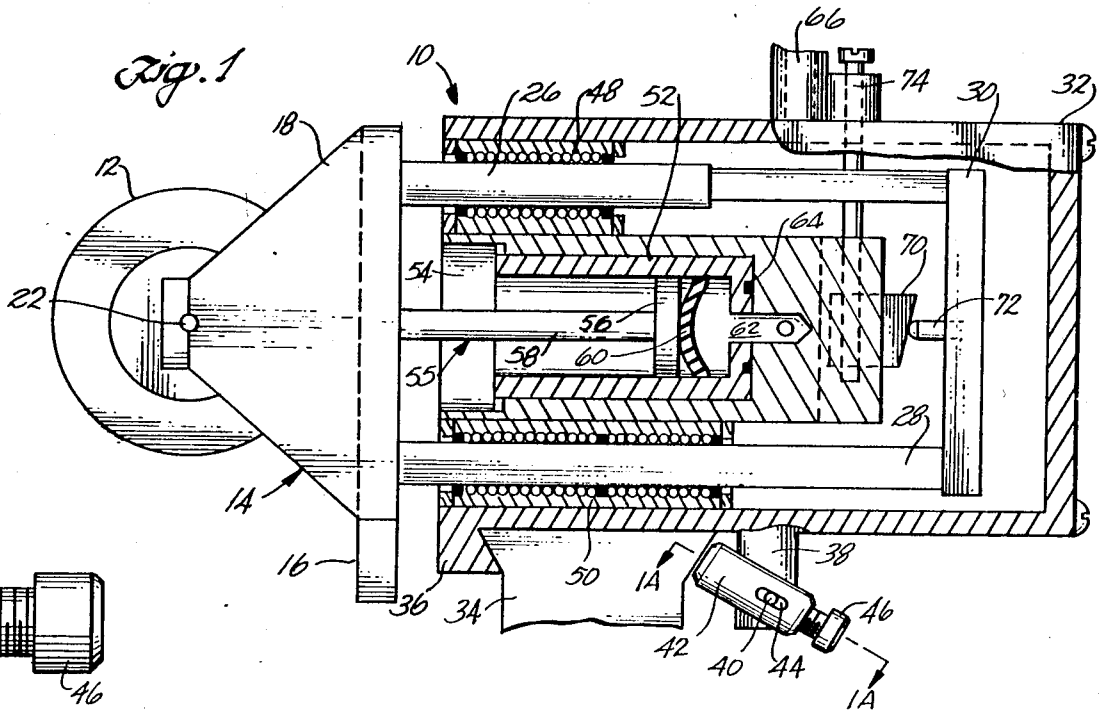
FIG. 1 shows a schematic sectional side view of an apparatus for applying constant pressure in crush-scoring according to the present invention.
Figure 1A:
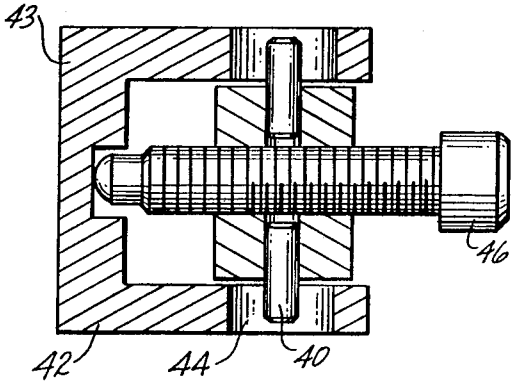
FIG. 1A, at section A—A, shows in greater detail the means by which to secure the crush-scoring apparatus to a mounting bracket.

The present invention pertains to an apparatus for crush-scoring paper, in which apparatus a circular knife blade is supported in a substantially frictionless manner There is applied to a web, at the knife edge of the blade, an unbiased, constant crushing pressure. The following is a description of a preferred embodiment of the invention as shown in the drawings.

With reference to FIGS. 1, 1A, 2, 4, and 6, knife holder 10 has a circular knife blade 12 rotatably supported by mounting bracket 14. Mounting bracket 14 is preferably one piece, and is comprised of end-member 16, from which a pair of panel members 18 and 20 extend outwardly, parallel to one another. Cylindrical pin 22 extends between panel members 18 and 20 at a point remote from end-member 16. Pin 22 extends through a corresponding hole in the center of knife blade 12. The knife blade freely rotates about pin 22, preferably through the use of ball or roller bearings.

Figure 4:
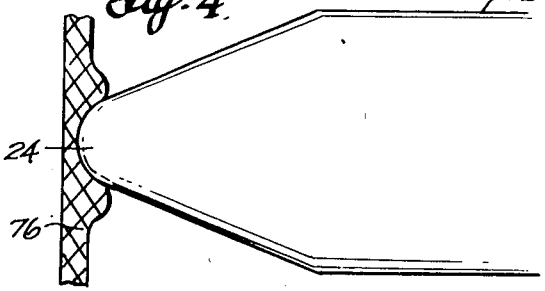
FIG. 4 shows a magnified top view of the point where the apparatus of FIG. 1 contacts the backing-sheet web.

Knife blade 12 should be as perfectly circular as possible. As shown in FIG. 4, the knife blade has a rounded tip 24. The radius of this tip is preferably from about 0.005 to about 0.02 inch. Sharp-edged knives may be used where it is desired to cut through the paper.

Extending outward from the surface of end-member 16 of mounting bracket 14, opposite knife blade 12, are a pair of smooth guide rods 26 and 28, which are preferably cylindrical, as shown. The guide rods extend, parallel to one another, outward from opposite ends of end-member 16 of mounting bracket 14. The opposed or remote ends of guide rods 26 and 28 are joined to one another by connecting brace 30 extending between them.

The cylindrical guides, over most of their length, and the connecting brace, are enclosed in a support cabinet 32. The underside of cabinet 32 is adapted to be attached to mounting pedestal 34 for installation of the knife holder at a work site. To accomplish this, the edge of the underside of cabinet 32 nearest the knife blade, has a lip 36 extending downward, which dovetails with the top of pedestal 34. With additional reference to FIG. 1A, also extending downward from the underside of cabinet 32, remote from lip 36 so that it will be on the opposite side of pedestal 34 from lip 36, is a screw mount 38. At the free end of screw mount 38, a pair of cylindrical pins 40 extend outward from opposite sides of screw mount 38 to hold lockpiece 42 in place by extending thru elongated apertures 44 on opposite sides of lockpiece 42. Lockpiece 42 is U-shaped, with the opposing sides being on either side of screw mount 38 and bottom member 43, facing the pedestal. Screw 46 extends through screw mount 38 so that its rounded end comes in contact with bottom member 43 of lockpiece 42. Lockpiece 42 is tightened against pedestal 34, by tightening screw 46, which forces lockpiece 42 against the other slanted surface of pedestal 34, to hold knife holder 10 in place. Elongated apertures 44 in the opposing sides of lockpiece 42, determine the amount of play available for tightening.

Guide rods 26 and 28 are supported in cabinet 32 only by sets of low-friction bearings 48 and 50, preferably linear ball bearings. In the presently preferred embodiment, these low-friction bearings would be Thompson ball bearings, but it should be understood that any bearing providing substantially frictionless support, may be used. Bearings 48 and 50 allow movements of guide rods 26 and 28 in and out of the support, substantially without friction.

To provide controlled pressure to knife blade 12, pneumatic cylinder 52 is provided within cabinet 32. The central, longitudinal axis of the pneumatic cylinder is substantially parallel to guide rods 26 and 28, and intersects the center of knife blade 12. The end of the cylinder closest knife blade 12, is capped with cylinder head 54. Plunger 56 is loosely and frictionlessly fitted inside pneumatic cylinder 52, with its head extending across its cross-section. Plunger rod 58 frictionlessly extends out along the central, longitudinal axis of pneumatic cylinder 52 thru cylinder head 54, and in use, contacts end-member 16 of mounting bracket 14. Where the rod passes through cylinder head 54, sufficient clearance is provided to make the fit relatively loose. The loose fit of the plunger, enables the movement within the cylinder with little, or essentially no, friction, with guide rods 26 and 28 being relied on to insure proper knife positioning.

On the other side of the plunger 56, opposite guide rod 58, flexible diaphragm 60 extends across the inside cross-section of pneumatic cylinder 52. In the end of the cylinder, opposite cylinder head 54, is inlet 62, through which a compressed gas, or its equivalent, can be fed to the portion of pneumatic cylinder 52 on the side of the diaphragm opposite the plunger. When the compressed gas is fed to the cylinder, it will deflect the diaphragm, communicating the gas pressure through the plunger and mounting bracket, to the point where the knife blade contacts the material being crush-scored. The use of the diaphragm allows the plunger to be loosely fitted without the use of friction-creating gaskets, which would be necessary if the plunger had to have an airtight seal with the wall of the cylinder. Gasket 64, between the outer surface of the the end wall of the cylinder and the cabinet portion supporting the cylinder, prevents compressed gas from leaking around the cylinder.

Figure 2:
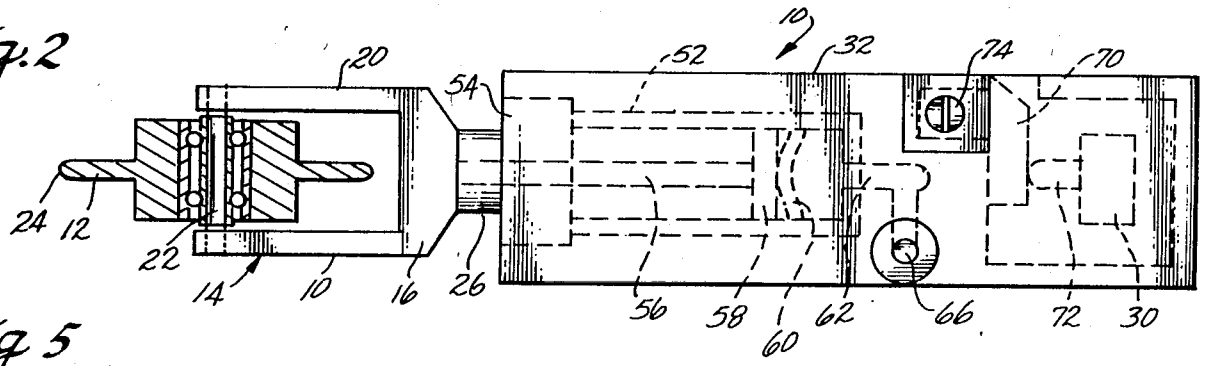
FIG. 2 shows a schematic top view of the apparatus of FIG. 1.

Compressed gas is fed to inlet 62 through connecting conduit 66, which extends out of cabinet 32 to a source of pressure-regulated compressed gas (not shown). The pathway of conduit 66 through cabinet 32, is shown in FIGS. 1 and 2, in combination. Sufficient pressure is made available to deliver a force to the point of knife-blade contact, to crush the paper. This force should remain constant, even if there are irregularities in the diameter of the knife blade or the thickness of the material being crush-scored, because the knife blade will be able to float with the irregularities, due to the substantially frictionless support and compressability of the gaseous fluid through which the force is applied.

While it is advantageous to minimize the friction present when the knife blade moves, it is also necessary to provide a zero point for the knife blade, to prevent it from coming in contact with the hard surface of anvil 68 (FIG. 3), used to support opposite the knife blade, the material to be crush-scored. Such contact could damage the anvil and/or the knife blade. A zero point is provided by screw-adjusted wedge 70. Screw-adjusted wedge 70 has a slanted surface which presses against set pin 72, extending outward from the surface of connecting brace 30. In combination with adjustment of differential screw 74, the slanted surface of wedge 70 can be moved across set pin 72, to arrive at a zero point from which knife blade 12 extends, on application of pressure, to diaphragm 60. The zero point is determined by turning screw 74, which in turn induces travel to the wedge, which is threaded to the screw and is driven thereby. As indicated, changing the position of the wedge, changes on its slanted surface the point at which set pin 72 will contact. Screw 74 extends up and out of cabinet 32 for easy access. A segment of guide 26 has a narrower diameter to allow room for conduit 66 and screw 74. FIG. 2 shows the zero-point-adjustment feature as seen from above.

Figure 3:
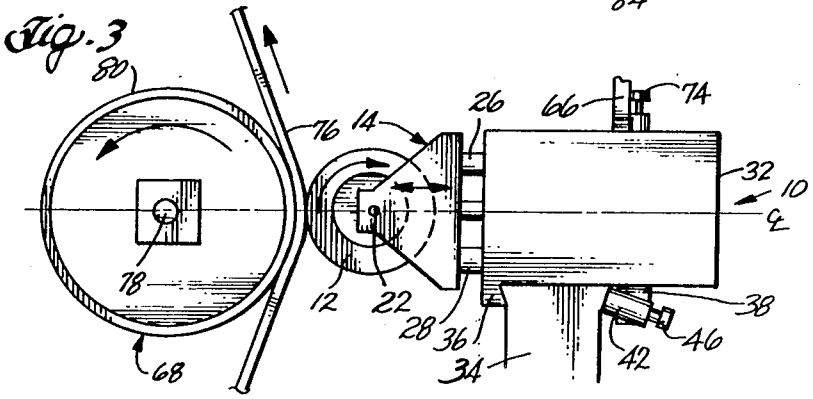
FIG. 3 shows a schematic side view of the apparatus of FIG. 1 in operation, crush-scoring a backing-sheet web.

FIG. 3 shows the cooperation between knife holder 10 and anvil 68 with a paper backing sheet 76 being crush-scored. An enlarged view of the action of the knife blade on the backing sheet, is shown in FIG. 4. The anvil is cylindrical, and rotates about the axis determined by precision bearings 78. The surface of the anvil is comprised of hardened steel sleeves 80. These sleeves can be individualy removed for repair, if one becomes damaged. Multiple sleeves are used along the length of the anvil to minimize replacement costs, by allowing replacement of only the damaged section. A single anvil could be used in conjunction with a number of knife holders, placed side by side. The centerline, or axis, of the anvil is in line with the center of pin 22 and the centerline of plunger rod 58.

Figure 5:
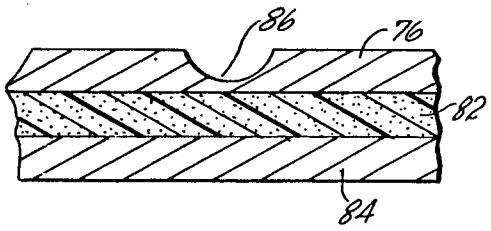
FIG. 5 shows an idealized side view of a product with a crush-scored backing sheet.
Figure 6:
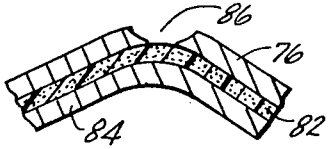
FIG. 6 shows a sectional magnified side view of the product of FIG. 5, flexed to cause cracking at the crush-score.

With reference to FIG. 5, paper stock for release liner 76, has been secured to adhesive layer 82, which in turn is secured to surface sheet 84. A crush-score mark 86 is shown in side view. The thickness of backing sheet 76 is from about 0.003 to about 0.008 inch. The amount of compaction allowed, is sufficient to enable the backing sheet to split or tear when flexed, as shown in FIG. 6, and still be sufficiently sturdy to withstand peel-across at crush-score lines.

The preceding description has been presented with reference to a presently preferred embodiment of the invention shown in the accompanying drawings. Workers skilled in the art and technology to which this invention pertains, will appreciate that alterations and changes in the described apparatus and structure can be practiced without meaningfully departing from the principles, spirit and scope of this invention. Accordingly, the foregoing description should not be read as pertaining only to the precise structures and techniques described, but rather should be read consistent with, and as support for, the appendant claims, which are to have their fullest fair scope, as further supported by the following explanation related to structure and use of the system.

The principal objective in the use of the apparatus of the instant invention, is to keep it operative under essentially frictionless conditions with only a unilateral force being applied through the fluid pressure against the diaphragm, such that the knife edge will float with fluctuations in paper thickness. The use of gaseous pressure is preferred, as compressability of the gas allows for movement of the knife blade to and from cabinet 32 without any significant changes in applied pressure. However, to minimize any fluctuations, the knife diameter and the diameter of the roll, are machined to as close a tolerance as possible. While cylindrical guide rods are currently used, they may be of any cross-sectional configuration, so long as there are available for them, bearings to enable essentially frictionless movement in and out of cabinet 32.

Similarly, since rod 58 may also be of any cross-sectional configuration, as it is essentially mounted in cooperation with cap 56 and diaphragm 60 in a frictionless manner. With reference to FIG. 3, the paper to be scored 76 is passed between knife blade 12 and the outer surface 80 of anvil 68. Any number of knives may be mounted on support 34 in a parallel array. The amount of pressure applied to diaphragm 60 determines the compressive force to be applied to crush-score paper 76. With the aid of backlighting, an operator can view from above, the direction of paper travel, and can ascertain if the depth of score, both in the direction of travel of any one knife, and relative to a plurality of knives in parallel, and, by adjusting the pressure associated with each knife against the diaphragm, can insure that the crush-score will be uniform throughout the length of the paper. This insures, when the paper is coated with a release material such as a silicone release coating after scoring and then laminated to an adhesive and a face-stock, that there will be at all times, uniform performance in the crack-and-peel operation of the construction.

To this end, it is desired that the paper be scored before applying a low-energy release surface on the opposed side thereof, for, if earlier applied, the pressure applied during the scoring operation could crack the release coating and provide a product of inferior quality.

In the assembly as depicted, the diameter of the anvil roller is about twice the diameter of the knives. Both the anvil roller and knives are machined to a rotational tolerance of about 0.0005 TIR.

What is claimed is:

1. An apparatus for applying a constant force to a mounting bracket which comprises:

(a) a mounting bracket providing means for receiving axially rotatable pressure means, for operating on a substrate;

(b) a pair of guide rods attached to, and extending in a direction away from, the means for receiving axially rotatable pressure means, said guide rods being parallel to one another and in substantially the same direction;

(c) a support receiving the pair of guides in a corresponding pair of substantially frictionless bearings to enable the guides to move back and forth within the support substantially without friction;

(d) a substantially frictionless plunger means positioned between the guide rods and extending from the mounting bracket into the support; and (e) means contained by the support for applying a predetermined unbiased force to the mounting bracket through the substantially frictionless plunger means.

2. An apparatus as described in claim 1 wherein the means for applying the force to the frictionless plunger is comprised of:

(a) a cylinder providing an interior surface and an internal cross-section; and (b) a flexible diaphragm having a first surface and an opposed second surface extending across the cross-section of the cylinder, the first surface defining a first chamber and the second surface defining a second chamber, the first chamber receiving, and providing for, contact of the diaphragm with the frictionless plunger means, and the second chamber being in communication with fluid means for introducing a predetermined fluid force into the second chamber for transmittal by the frictionless plunger means to the mounting bracket.

3. An apparatus for crush-scoring paper which comprises:

(a) a mounting bracket having a circular crushing knife blade rotatably attached to one end of the mounting bracket at the center of the circular knife blade;

(b) a pair of parallel guide rods attached to the opposite end of the mounting bracket and extending outward from said opposed end of the mounting bracket into a pair of substantially frictionless bearings which receive said guide rods in close relation and contained in a support, the bearings enabling the guide rods to move substantially without friction in and out of the support;

(c) a plunger positioned between the guide rods and extending between the mounting bracket and a first surface of a flexible diaphragm, which extends across the internal cross-section of a cylinder having an internal surface, said first surface defining in the cylinder a first chamber for receiving the plunger, said diaphragm having a second surface defining a second chamber; and (d) means to introduce a gaseous pressure to the second chamber to induce a force against the diaphragm, for application to the plunger and in turn to the mounting bracket.

4. An apparatus for crush-scoring paper which comprises:

(a) a plurality of crush-scoring knife assemblies, each providing crushing knives in parallel, each crush-scoring knife assembly comprising:

(i) a mounting bracket having a circular crushing knife blade rotatably attached to one end of the mounting bracket at the center of the circular crushing knife blade;

(ii) a pair of parallel guide rods attached to ends of the mounting bracket, opposite the center of the circular crushing knife blade, and extending outward from said opposed ends of the mounting bracket into a pair of substantially frictionless linear ball bearings and contained in a support, the bearings enabling the guide rods to move substantially without friction in and out of the support;

(iii) a cylinder having an internal surface and an internal cross-section;

(iv) a flexible diaphragm extending across the internal cross-section of the cylinder, said diaphragm providing a first surface defining a first chamber and a second surface defining a second chamber;

(v) a plunger positioned between the guide rods and frinctionlessly extending from the exterior of the cylinder into the cylinder, for contact with the first surface of the diaphragm and the mounting bracket; and (b) anvil means cooperating with and facing the plurality of crush-scoring knife assemblies, said anvil means having a surface for receiving paper against which said crush-scoring knife blades can apply a crushing force upon pressurizing the second chamber of the cylinder.

5. An apparatus as claimed in claim 4 which includes means on said crush-scoring knife assemblies adapted to adjust the position of each knife blade relative to the anvil in the absence of applied gaseous pressure.

6. An apparatus as claimed in claim 5 in which the means to adjust the position of the knife blade comprises:

(a) a bar coupling the parallel guide rods at a position opposite said mounting bracket;

(b) a block having an inclined surface facing said bar and selectively movable in said support along and spaced from said bar;

(c) means to selectively position said block along said bar; and (d) pin means coupled to said bar and engaged in the inclined surface of said block, the position of the knife blade relative to the anvil being determined by the relative position of said pin means along the inclined surface of said block.

* * * * *